US011295879B2

(12) United States Patent
Kumar

(10) Patent No.: US 11,295,879 B2
(45) Date of Patent: Apr. 5, 2022

(54) SURGE ARRESTERS AND RELATED ASSEMBLIES AND METHODS

(71) Applicant: TE CONNECTIVITY SERVICES GMBH, Schaffhausen (CH)

(72) Inventor: Senthil A. Kumar, Morrisville, NC (US)

(73) Assignee: TE CONNECTIVITY SERVICES GMBH, Schaffhausen (CH)

( * ) Notice: Subject to any disclaimer, the term of this patent is extended or adjusted under 35 U.S.C. 154(b) by 0 days.

(21) Appl. No.: 16/937,895

(22) Filed: Jul. 24, 2020

(65) Prior Publication Data

US 2022/0028588 A1 Jan. 27, 2022

(51) Int. Cl.

| | |
|---|---|
| ***H01C 7/12*** | (2006.01) |
| ***H01H 85/044*** | (2006.01) |
| ***H01H 85/02*** | (2006.01) |
| ***H01C 1/012*** | (2006.01) |

(52) U.S. Cl.

CPC ..... *H01C 7/12* (2013.01); *H01C 1/012* (2013.01); *H01H 85/0241* (2013.01); *H01H 85/044* (2013.01)

(58) Field of Classification Search

CPC ..... H01C 7/12; H01C 1/012; H01H 85/044; H01H 85/0241; H01H 9/10

See application file for complete search history.

(56) References Cited

U.S. PATENT DOCUMENTS 4,686,603 A * 8/1987 Mosele ..... H01T 1/15 361/118
4,930,039 A * 5/1990 Woodworth ..... H01C 7/12 361/117
4,989,115 A 1/1991 Bourdages et al.
5,088,001 A * 2/1992 Yaworski ..... H01C 7/12 361/127
5,363,266 A * 11/1994 Wiseman ..... H01C 7/12 361/127
5,497,138 A * 3/1996 Malpiece ..... H01C 7/12 338/21
5,680,289 A * 10/1997 Robinson ..... H01C 7/126 338/21
6,667,871 B2 * 12/2003 Berlovan ..... H01C 7/126 361/111
6,777,614 B1 8/2004 Olaf (Continued)

FOREIGN PATENT DOCUMENTS

DE 3607596 A1 * 9/1987 ..... H01H 85/306
WO WO 2007/008957 * 1/2007 ..... H01R 13/53

OTHER PUBLICATIONS

"Raychem Screened, Separable Surge Arrester RSTI-SA-10 to 41 kV", Brochure for Raychem from TE Connectivity, 4 pages, available prior to filing date.

*Primary Examiner* — Kyung S Lee

(57) ABSTRACT

A surge arrester includes a polymer body or housing and a varistor assembly in the body or housing. The varistor assembly includes a plurality of varistor elements and a fuse electrically connected in series and forming a vertical stack of the plurality of varistor elements and the fuse. The stack has a first end surface, a second end surface, and a side surface extending between the first end surface and the second end surface. The varistor assembly includes a first end fitting at the first end surface of the stack and a second end fitting at the second end surface of the stack.

20 Claims, 18 Drawing Sheets

(56) References Cited

U.S. PATENT DOCUMENTS

| | | | | |
|---|---|---|---|---|
| 7,168,983 | B2 | 1/2007 | Graf et al. | |
| 7,522,399 | B2 | 4/2009 | Siljeholm et al. | |
| 8,009,402 | B2 | 8/2011 | Hartmut | |
| 8,018,707 | B2 * | 9/2011 | Yaworski | H01R 13/443 361/127 |
| 8,305,184 | B2 | 11/2012 | Klaube et al. | |
| 8,375,552 | B2 | 2/2013 | Normoyle et al. | |
| 8,629,751 | B2 | 1/2014 | Maher et al. | |
| 8,982,526 | B2 * | 3/2015 | Anjiki | H01C 7/10 361/127 |
| 10,304,598 | B1 | 5/2019 | Pusthay et al. | |
| 2015/0055265 | A1 * | 2/2015 | Krauss | H01T 1/12 361/102 |

* cited by examiner

SURGE ARRESTERS AND RELATED ASSEMBLIES AND METHODS

BACKGROUND

Surge arresters are used to protect equipment connected to power distribution networks from damage by excessive voltage situations caused by lightning strikes, switching surges, incorrect connections, and other abnormal conditions or malfunctions.

The active element in a surge arrester is often a varistor, also referred to as a non-linear varistor because it exhibits a non-linear current-voltage relationship. If the applied voltage is less than a certain voltage (the switching or clamping voltage), the varistor is essentially an insulator and only a small leakage current flows through it. If the applied voltage is greater than the switching voltage, the varistor's resistance drops, allowing an increased current to flow through it. That is, a varistor is highly resistive below its switching voltage and substantially conductive above it.

The surge arrester is commonly attached to electrical equipment with one terminal of the device connected to a conductive member (e.g., bushing) of the equipment and the other terminal to ground. At normal system voltages, the surge arrester is resistant to current flow (except for the leakage current). However, if an overvoltage condition exceeding the switching voltage develops, the surge arrester becomes conductive and shunts the surge energy to ground while "clamping" or limiting the system voltage to a value which can be tolerated without damage to the equipment being protected.

SUMMARY

Some embodiments of the present invention are directed to a surge arrester. The surge arrester includes a polymer body or housing and a varistor assembly in the body or housing. The varistor assembly is in the first body or housing. The varistor assembly includes a plurality of varistor elements and a fuse electrically connected in series and forming a vertical stack of the plurality of varistor elements and the fuse. The stack has a first end surface, a second end surface, and a side surface extending between the first end surface and the second end surface. The varistor assembly includes a first end fitting at the first end surface of the stack and a second end fitting at the second end surface of the stack.

In some embodiments, the fuse includes a body, a first endcap at a first end of the body, and a second endcap at a second, opposite end of the body.

In some embodiments, the fuse is positioned at a top of the stack such that the first endcap defines the first end surface of the stack and the plurality of varistor elements are positioned below the fuse.

In some embodiments, the first endcap contacts the first end fitting.

In some embodiments, an annular semiconductor layer contacts and surrounds the second endcap. The annular semiconductor layer may completely surround the fuse and optionally completely surround the stack. The annular semiconductor layer may contact each of the fuse body and the varistor element directly below the fuse.

In some embodiments, the fuse is positioned at an interior of the stack with at least one of the plurality of varistor elements above the fuse and at least one of the plurality of varistor elements below the fuse. A first annular semiconductor layer may contact and surround the first endcap. A second annular semiconductor layer may contact and surround the second endcap. The second annular semiconductor layer may be vertically spaced apart from the first annular semiconductor layer. The first annular semiconductor layer may contact each of the fuse body and the varistor element directly above the fuse. The second annular semiconductor layer may contact each of the fuse body and the varistor element directly below the fuse.

In some embodiments, fuse is positioned at a bottom of the stack such that the second endcap defines the second end surface of the stack and the plurality of varistor elements are positioned above the fuse. The second end cap may contact the second end fitting. The annular semiconductor layer may be a first annular semiconductor. The surge arrester may further include a second annular semiconductor layer contacting and surrounding the second endcap. The first annular semiconductor layer may contact each of the fuse body and the varistor element directly above the fuse. The second annular semiconductor layer may contact each of the fuse body and the second end fitting.

In some embodiments, the fuse includes a striker pin that, upon operation of the fuse, protrudes through the second endcap and operates an indicator that is visible from below the surge arrester.

In some embodiments, an indicator is electrically connected to the stack and configured to indicate when the fuse has operated. The indicator may be on the body.

In some embodiments, the body or housing includes a first leg having a first channel defined therein and a second leg perpendicular to the first leg and having a second channel defined therein. The second channel may be configured to receive a bushing. The varistor assembly may be in the first channel.

In some embodiments, the surge arrester may include (i) a cage in the body or housing and including a plurality of rods surrounding the stack or (ii) a wrap in the body or housing and completely surrounding the stack.

Some other embodiments of the present invention are directed to a method including providing a surge arrester including: a body or housing; and a varistor assembly in the body or housing, the varistor assembly including a plurality of varistor elements and a fuse electrically connected in series and forming a vertical stack of the plurality of varistor elements and the fuse. The method includes: connecting the surge arrester to electrical equipment; operating the fuse in response to current over a rated current of the fuse; and activating or providing an indicator in response to operating the fuse.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1:
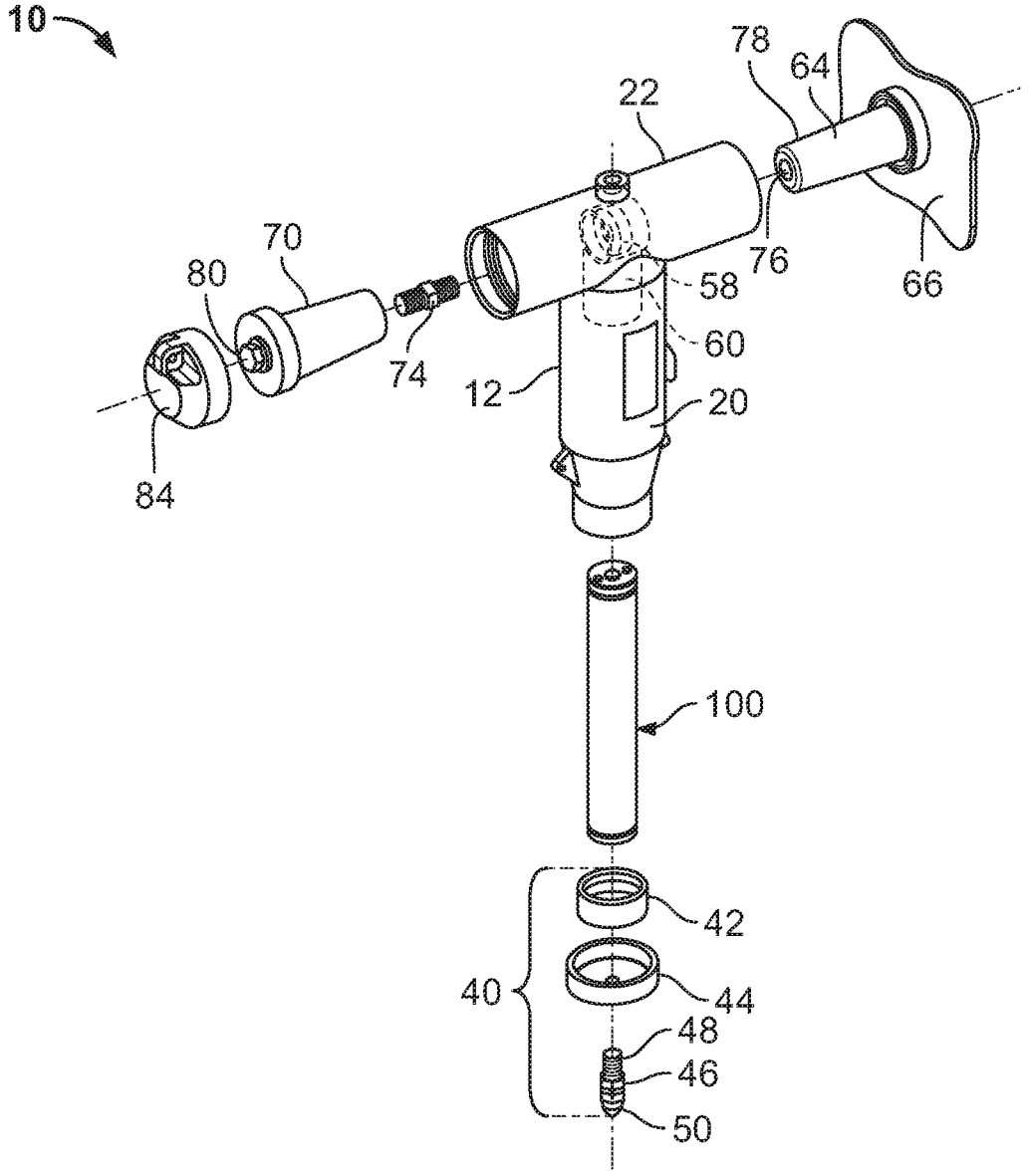
FIG. 1 is an exploded perspective view of a surge arrester according to some embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2A:
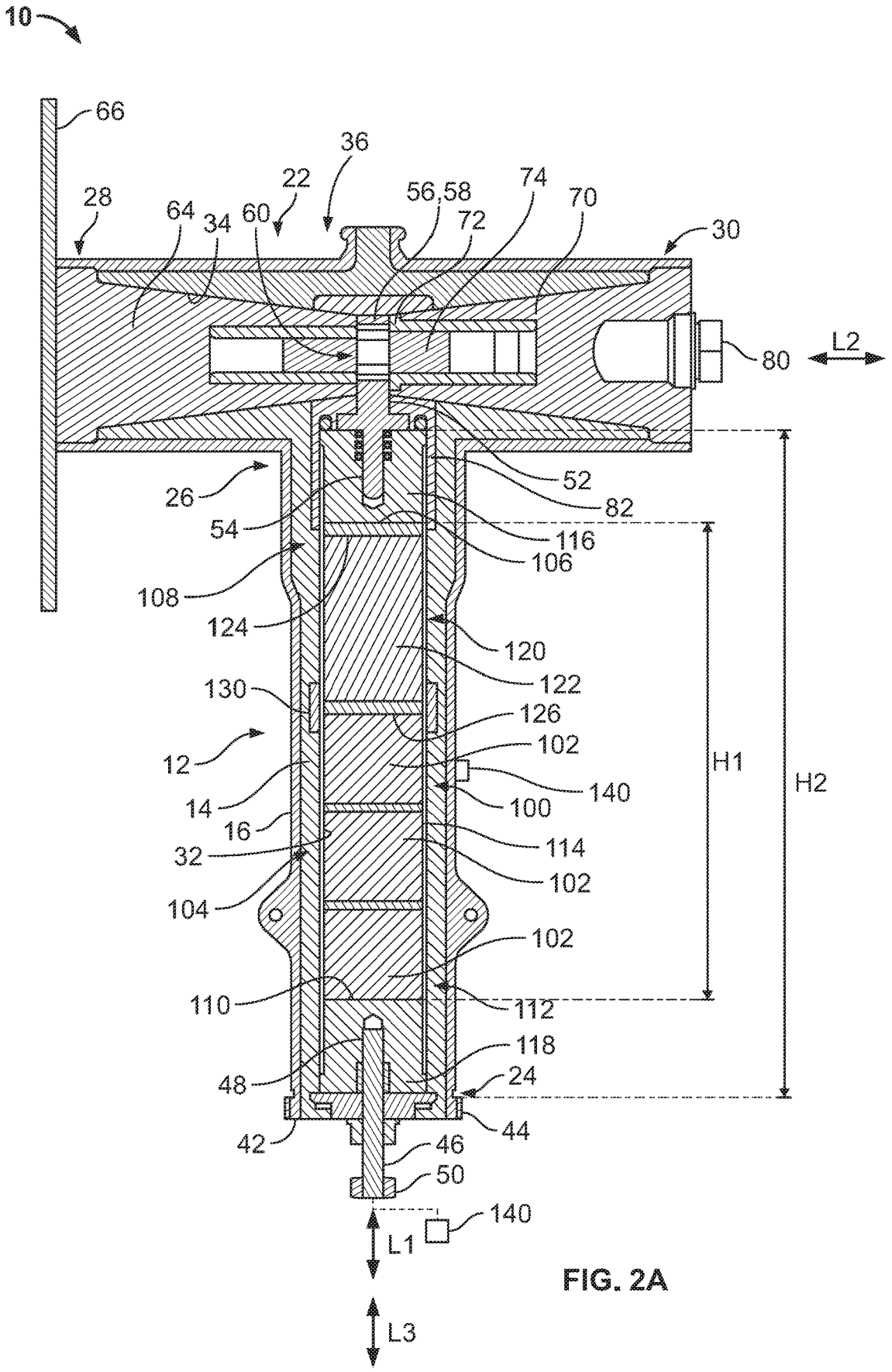
FIGS. 2A-2D are sectional views of the surge arrester of FIG. 1 connected to electrical equipment according to some embodiments.

A surge arrester 10 according to some embodiments is illustrated in FIG. 2A. The surge arrester 10 includes a body or housing 12 such as a polymer body. The body 12 may be formed of an elastomer such as EPDM rubber. The body 12 may include an inner portion or layer 14 and an outer portion or layer 16. The inner portion 14 may be electrically insulating (e.g., insulating EPDM) and the outer portion 16 may be electrically conductive (e.g., conductive EPDM).

The body 12 is T-shaped and includes a first leg 20 and a second leg 22. The first leg 20 includes first and second opposite ends or end portions 24, 26 and the second leg 22 includes first and second opposite ends or end portions 28, 30. A first channel or passage 32 is defined in the first leg 20 and extends from the first end 24 to the second end 26. A second channel or passage 34 is defined in the second leg 22 and extends from the first end 28 to the second end 30. The first channel 32 and the second channel intersect at the second end 26 of the first leg 20 and/or at a central portion 36 of the second leg 22.

The first leg 20 and/or the first channel 32 define a first longitudinal axis L1. The second leg 22 and/or the second channel 34 define a second longitudinal axis L2. The first longitudinal axis L1 and the second longitudinal axis L2 may be perpendicular or substantially perpendicular to one another.

The surge arrester 10 includes an internal varistor assembly 100 held in the first channel 32 of the first leg 20.

The varistor assembly 100 includes a plurality of varistor elements or blocks 102 that are arranged in a varistor stack 104 (also referred to herein as a "varistor and fuse stack"). As described in more detail below, also included in the stack 104 is a fuse 120. The stack 104 defines a third longitudinal axis L3. The longitudinal axis L3 of the stack is coaxial or parallel to the longitudinal axis L1 of the first leg 20. In some embodiments, each varistor element 102 is a metal-oxide varistor (MOV). In some embodiments, each varistor element 102 is disk shaped such that the stack 104 is cylindrical. Without limitation, the stack 104 may have a height or length H1 of between about 3 and 100 inches.

The stack 104 includes a first or upper end surface 106 at a first or upper end portion 108 of the stack 104 and an opposite second or lower end surface 110 at a second or lower end portion 112 of the stack 104. The stack 104 includes an outer (circumferential) side surface 114 that extends between the first and second end surfaces 106, 110. The outer (circumferential) side surface of the fuse 120 and the outer (circumferential) side surface of adjacent varistor element(s) may be flush or substantially flush. In other words, the stack 104 may have the same diameter or substantially the same diameter at each of the varistor blocks 102 and at the fuse 120.

The varistor assembly 100 includes a first or upper end fitting 116 at the first end surface 106 of the stack 104 and a second or lower end fitting 118 at the second end surface 110 of the stack 104. The first and second end fittings 116, 118 may be formed of an electrically conductive material such as aluminum. Without limitation, the assembly 100 including the stack 104 and the first and second end fittings 116, 118 may have a height or length H2 of between about 4 and 110 inches.

The varistor assembly 100 includes the fuse 120 that may include a primary body 122, a first or upper endcap 124, and a second or lower endcap 126. As shown in FIGS. 2A-2D, the fuse 120 may be positioned at the "top" of the varistor stack 104 above one or more varistor blocks 102. As illustrated, the fuse 120 is above three varistor blocks 102. In various other embodiments, the fuse 120 may be positioned above one varistor block, two varistor blocks, or more than three varistor blocks.

The first endcap 124 may define the first end surface 106 of the varistor stack 104. The first endcap 124 may contact the first end fitting 116. The second endcap 126 may contact one of the varistor blocks 102.

As described in more detail below, the body 12 may include an additional inner conductive layer 82 formed of conductive material (e.g., conductive EPDM). The layer 82 may surround an upper portion of the first channel 32 of the first leg 20 and may surround the first end fitting 116. The layer 82 may surround the first endcap 124.

There may be an annular semiconductor layer 130 around the second endcap 126. The layer 130 may help prevent discharge and/or ionization that may, for example, damage the surge arrester body 12. The semiconductor layer 130 may encourage current flow in the axial direction (e.g., along or parallel to the longitudinal axis L3 shown in FIG. 2A). The layer 130 may be formed of a semiconductive material.

The annular semiconductor layer 130 may contact and surround the second endcap 126. The annular dielectric layer 130 may contact each of the fuse body 122 and the varistor block 102 positioned directly below the fuse 120.

Figure 2B:
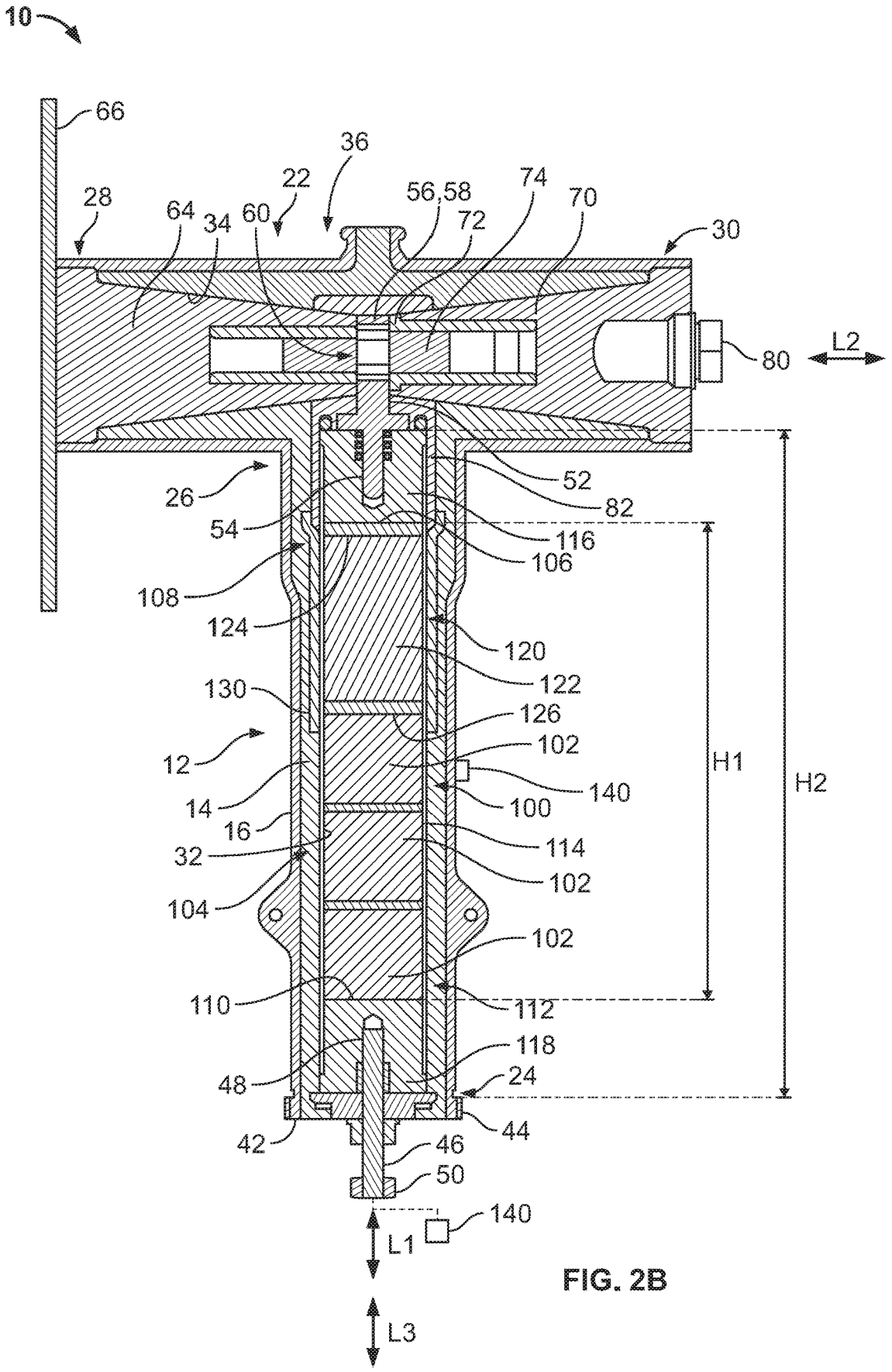

Referring to FIG. 2B, in some embodiments, the annular semiconductor layer 130 may completely surround the fuse 120. The layer 130 may extend from the second endcap 126 of the fuse 120 to the inner conductive layer 82. The layer 130 may contact the fuse second endcap 126, the fuse body 122, and/or the inner conductive layer 82.

Figure 2C:
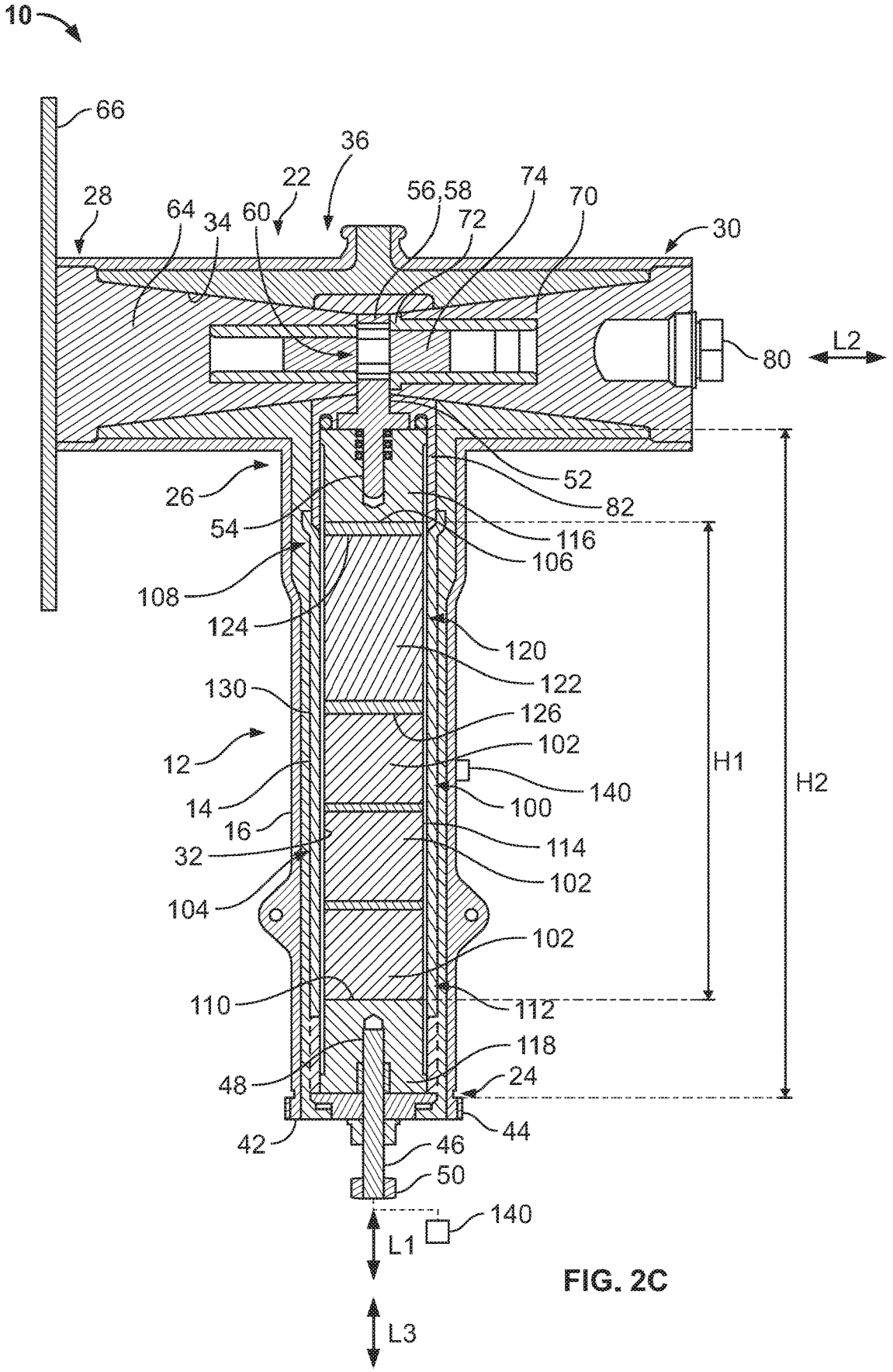

Referring to FIG. 2C, in some embodiments, the annular semiconductor layer 130 may completely surround the varistor stack 104. The layer 130 may extend from the second end fitting 118 to the inner conductive layer 82. The layer 130 may contact the second end fitting 118, the varistor stack 104, and/or the inner conductive layer 82.

Figure 2D:
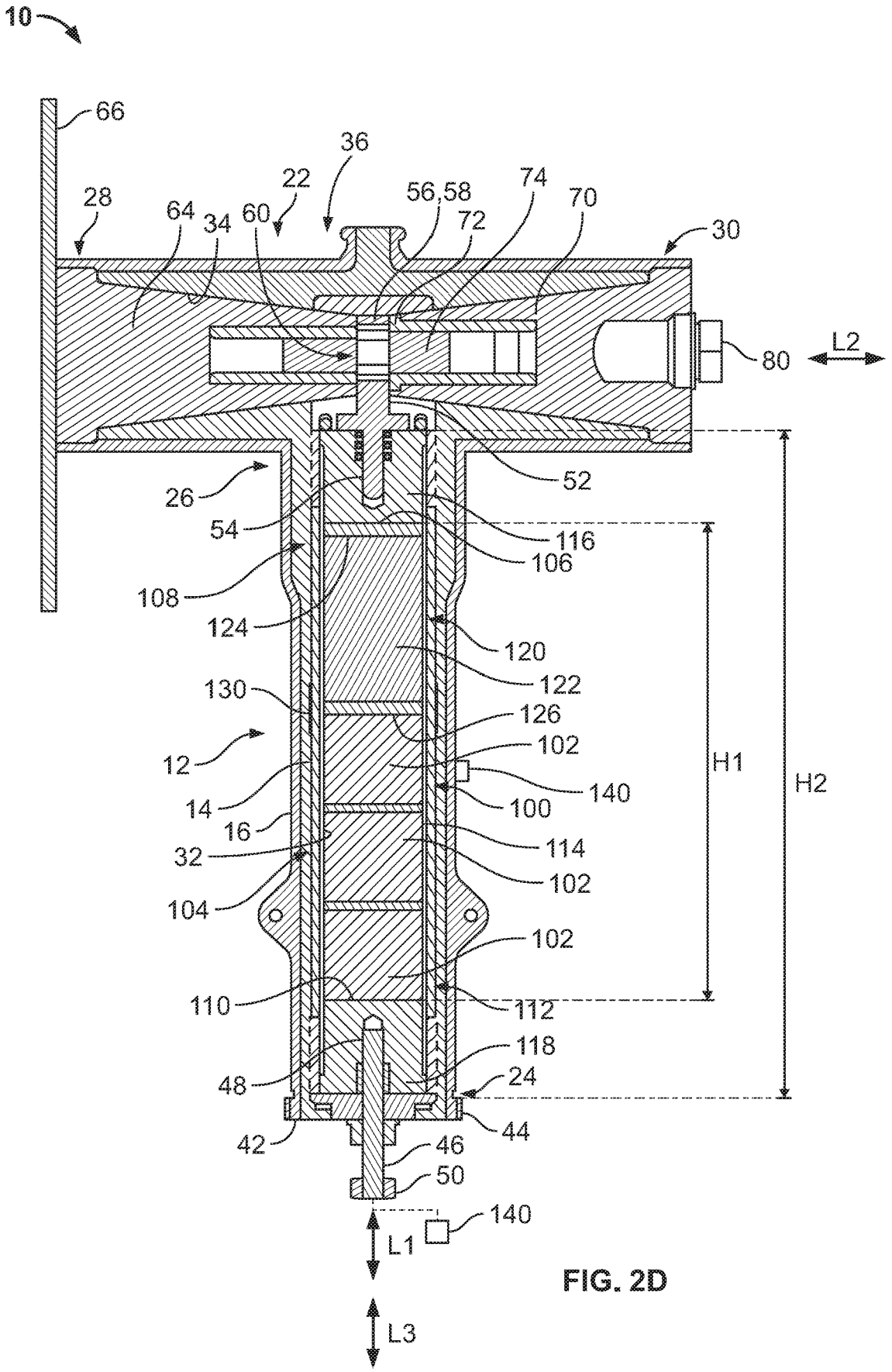

Referring to FIG. 2D, in some embodiments, at least a portion of the inner conductive layer 82 may be omitted. The annular semiconductor layer 130 may completely surround the varistor stack 104. The layer 130 may contact the second end fitting 118, the varistor stack 104, and/or the first end fitting 116. In some embodiments, and as shown in dashed lines, the layer 130 may completely surround the first end fitting 116 and/or the second end fitting 118.

The semiconductor layer could be a field stress control material that is resistive, capacitive, or a high permittivity dielectric. The primary purpose is to reduce electric field stress in the entire arrester.

Figure 3A:
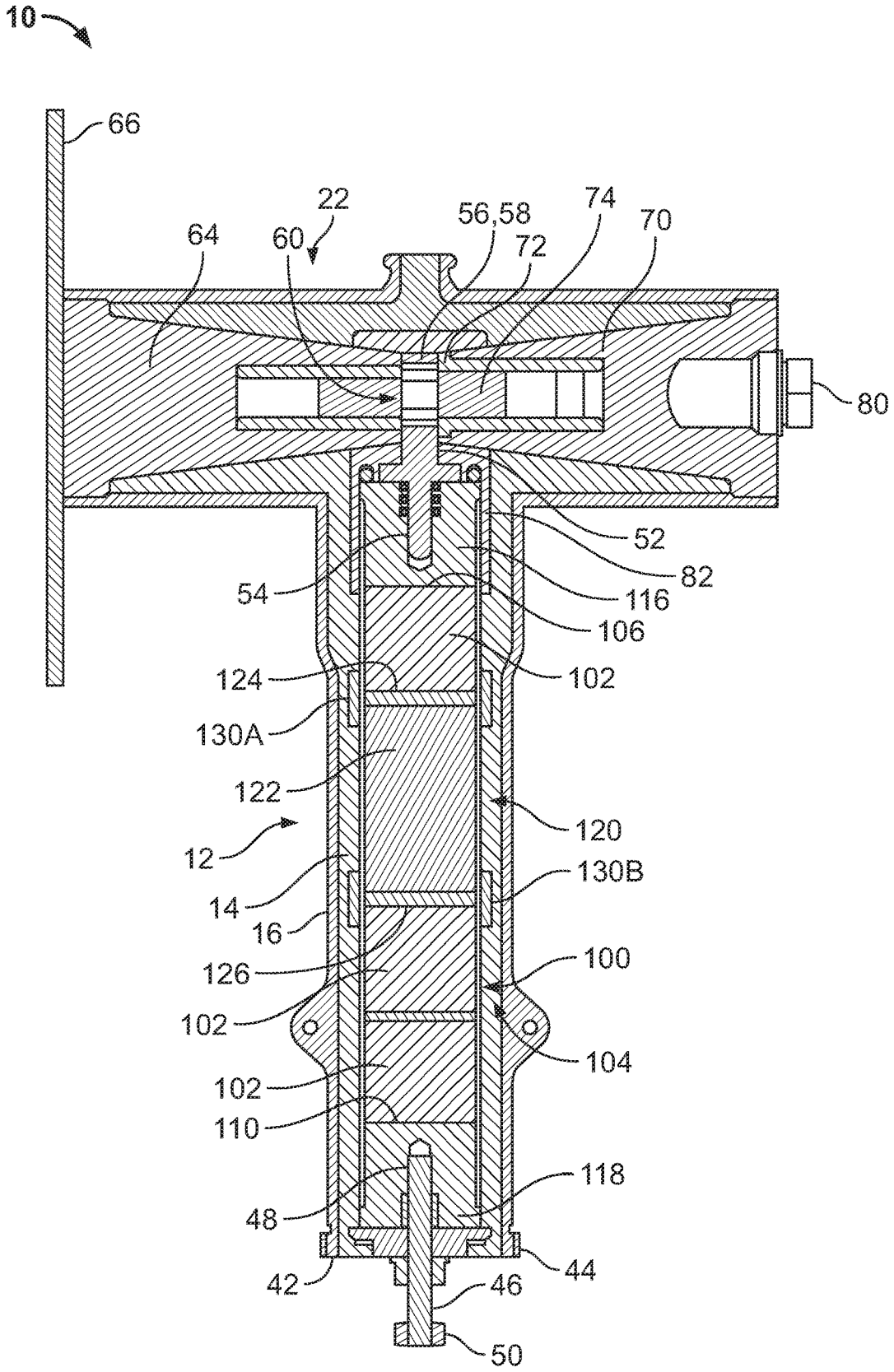
FIGS. 3A and 3B are sectional views of the surge arrester of FIG. 1 according to some other embodiments.
Figure 3B:
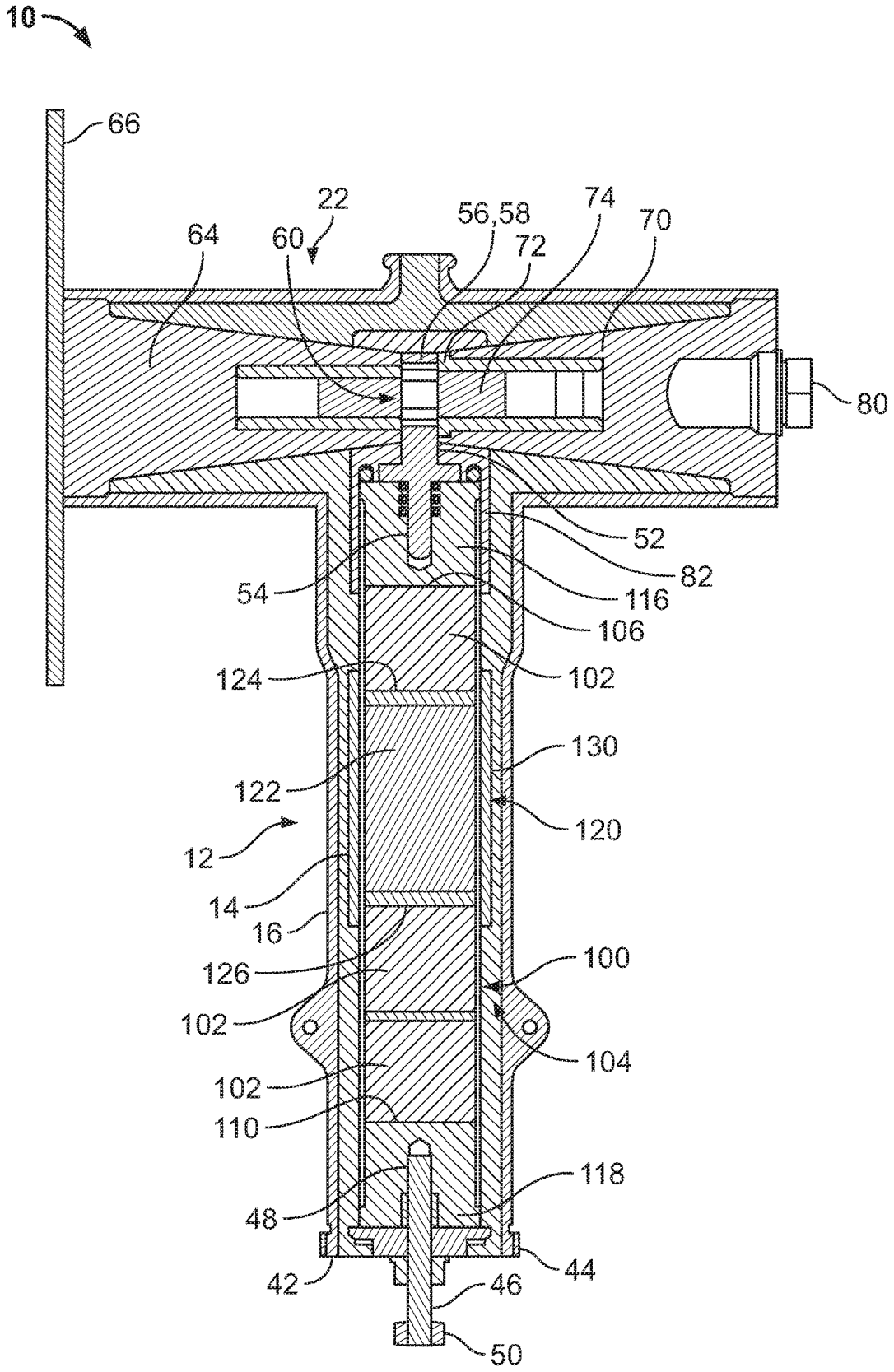

Referring to FIGS. 3A and 3B, the fuse 120 may alternatively be positioned in an interior of the varistor stack 104 with one or more varistor blocks 102 positioned above the fuse 120 and one or more varistor blocks 102 positioned below the fuse 120. As illustrated, one varistor block 102 is above the fuse 120 and two varistor blocks 102 are below the fuse 120. In some other embodiments, two or more varistor blocks 102 may be above the fuse 120. Also in some other embodiments, one varistor block 102 may be below the fuse 120 or more than two varistor blocks 102 may be below the fuse 120.

The first endcap 124 may contact one of the varistor blocks 102 and the second endcap 126 may contact another one of the varistor blocks 102.

A first annular semiconductor layer 130A may contact and surround the first endcap 124. The first annular semiconductor layer 130A may contact each of the varistor block 102 directly above the fuse 120 and the fuse body 122. A second annular semiconductor layer 130B may be spaced apart from the first annular semiconductor layer 130A and may contact and surround the second endcap 126. The second annular semiconductor layer 130B may contact each of the varistor block 102 directly below the fuse 120 and the fuse body 122. The layers 130A, 130B may be formed of a semiconductive material.

Referring to FIG. 3B, the semiconductor layer 130 may completely surround the fuse 120. The layer 130 may contact the first endcap 124, the fuse body 122, and/or the second endcap 126. The layer 130 may contact the varistor block 102 adjacent the first endcap 124 and/or the varistor block 102 adjacent the second endcap 126.

In some other embodiments, the semiconductor layer 130 may completely surround the varistor stack 104 as shown in FIGS. 2C and 2D.

Figure 4A:
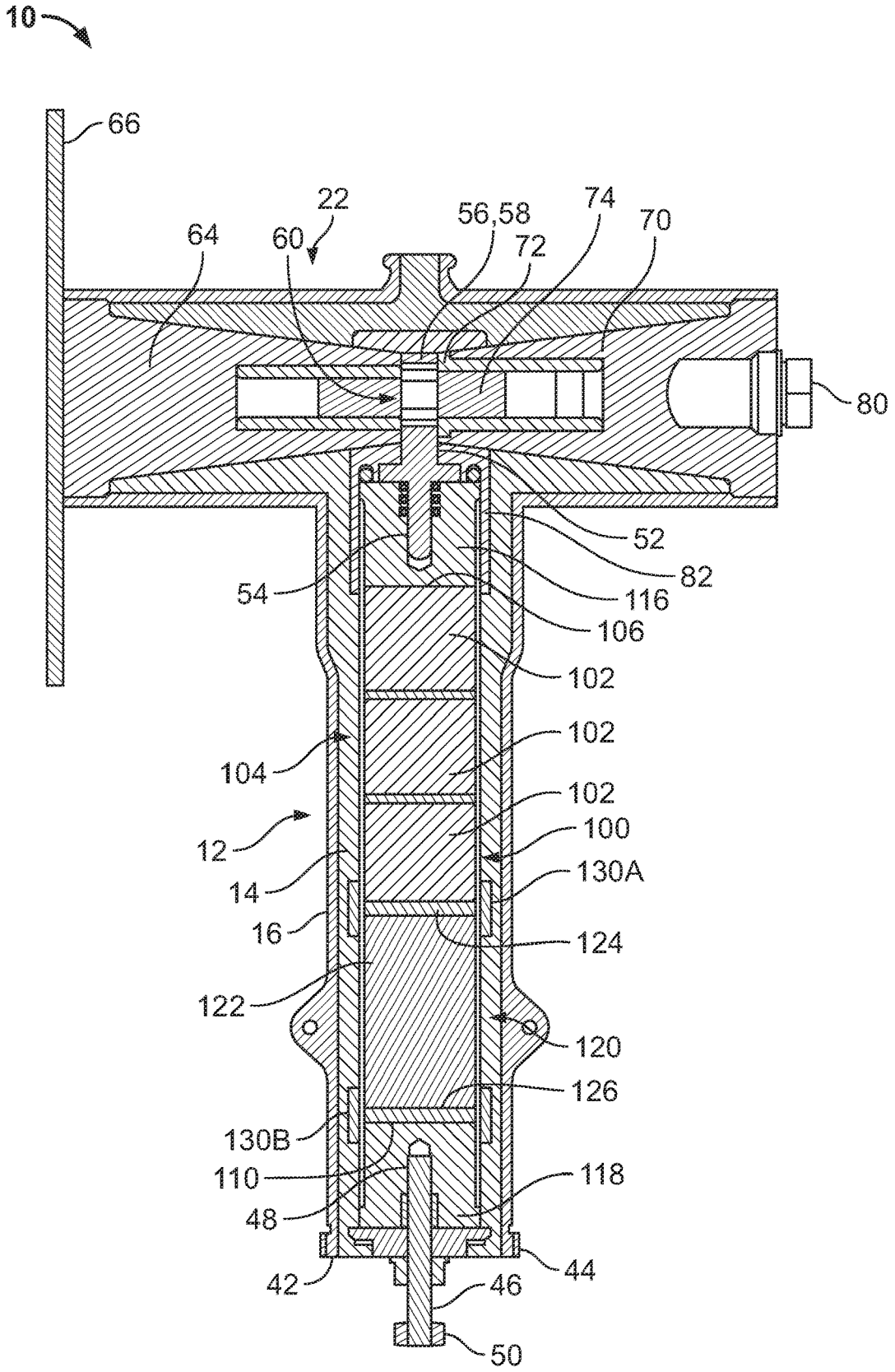
FIGS. 4A and 4B are sectional views of the surge arrester of FIG. 1 connected to electrical equipment according to some other embodiments.
Figure 4B:
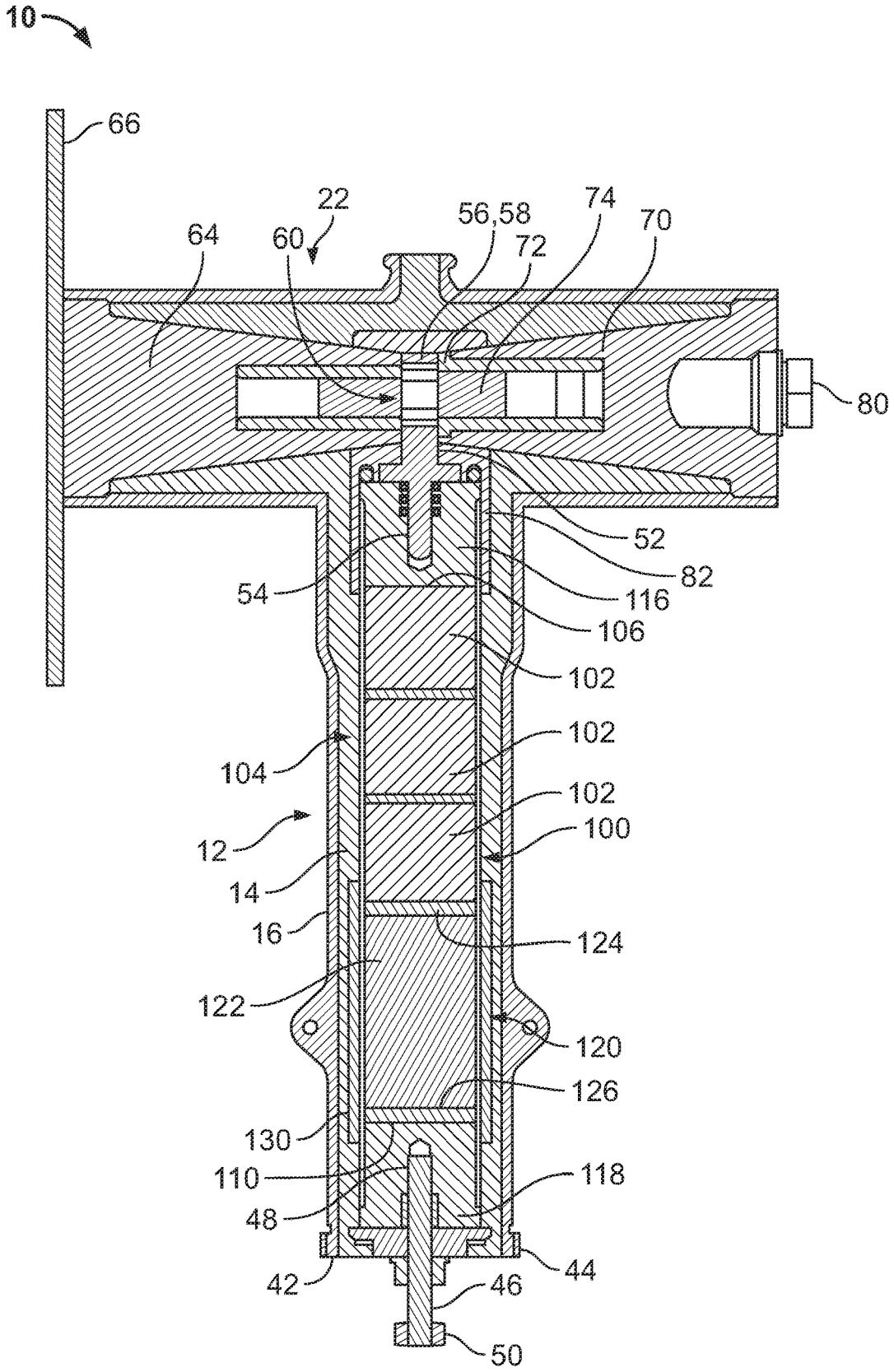

Referring to FIGS. 4A and 4B, the fuse 120 may alternatively be positioned at the "bottom" of the varistor stack 104 below one or more varistor blocks 102. As illustrated, the fuse 120 is below three varistor blocks 102. In various other embodiments, the fuse 120 may be positioned below one varistor block, two varistor blocks, or more than three varistor blocks.

The first endcap 124 may contact one of the varistor blocks 102. The second endcap 126 may define the second end surface 110 of the varistor stack 104. The second endcap 126 may contact the second end fitting 118.

A first annular semiconductor layer 130A may contact and surround the first endcap 124. The first annular semiconductor layer 130A may contact each of the varistor block 102 directly above the fuse 120 and the fuse body 122. A second annular semiconductor layer 130B may be spaced apart from the first annular semiconductor layer 130A and may contact and surround the second endcap 126. The second annular semiconductor layer 130B may contact each of the second end fitting 118 and the fuse body 122. The layers 130A, 130B may be formed of a semiconductive material.

Referring to FIG. 4B, the semiconductor layer 130 may completely surround the fuse 120. The layer 130 may contact the first endcap 124, the fuse body 122, the second endcap 126, and/or the second end fitting 118. The layer 130 may contact the varistor block 102 adjacent the first endcap 124.

In some other embodiments, the semiconductor layer 130 may completely surround the varistor stack 104 as shown in FIGS. 2C and 2D.

The varistor assembly 100 is held in the first channel 32 of the first leg 20. In some embodiments, the first leg 20 completely surrounds the assembly 100. In some embodiments, the body 12 is molded around the assembly 100. In some embodiments, the body 12 or the first leg 20 thereof directly contacts the outer side surface 114 of the varistor and fuse stack 104.

The semiconductor layers 130/130A/130B may be formed of a semiconductive material such as semiconductive tape that is wrapped around the varistor and fuse stack 104. Alternatively, the semiconductor layers 130/130A/130B may be formed of a semiconductive material and included as part of the surge arrester body 12.

Referring again to FIGS. 1 and 2A, an end cap assembly 40 may be coupled to the first end 24 of the first leg 20. The end cap assembly 40 includes an electrical connection to the varistor assembly 100 and may further help to retain the varistor assembly 100 in the body 12. The end cap assembly 40 may include end cap portions 42, 44 that secure the varistor assembly 100 in the first leg 20 of the body 12 and a ground connection 46 that extends through the end cap 40 and into the second end fitting 118. The ground connection 46 is electrically connected to the varistor stack 104 through the second end fitting 118. The ground connection 46 includes first and second opposite ends 48, 50. The first end 48 is electrically and mechanically connected to the second end fitting 118. The second end 50 extends outside the body 12 and is configured to be connected to an external ground.

The end cap may include a first end cap portion 42 and a second end cap portion 44. The first end cap portion 42 may be received in the first channel 32 of the first leg 20 and below the second end fitting 118. The second end cap portion 44 may be installed below the first end cap portion 42 and around the first leg 20. The second end cap portion 44 may be electrically shielded.

A lug 52 includes a first end portion 54 electrically and mechanically connected to the first end fitting 116 and a second end portion 56 positioned in the second channel 34 of the second leg 22 (e.g., at the central portion 36 thereof). The second end portion 56 of the lug 52 includes a head 58 that defines an opening or channel 60. The lug 52 is electrically connected to the stack 104 through the first end fitting 116.

A bushing receiving region is located in the second channel 34 of the second leg 22 between the first end 28 and the central portion 36 of the second leg 22. The bushing receiving region is configured to receive a bushing 64 from electrical equipment 66 (e.g., switchgear, transformer, etc.). The bushing 64 may be 200 Amp or 600 Amp standard shaped bushing.

A plug receiving region is located in the second channel 34 of the second leg 22 between the second end 30 and the central portion 36 of the second leg 22. The plug receiving region is configured to receive an insulating plug 70. The plug 70 has an end 72 that, in position, is at the central portion 36 of the second leg 22 and is configured to be coupled to the bushing 64. The bushing 64 and the plug 70 may be coupled together using a coupling component 74 such as a threaded rod or other fastener. The surge arrester 10 is secured in an assembled state when the bushing 64 is coupled to the plug 70.

In the assembled state, an end 76 of the bushing 64 may be received in the opening 60 of the lug 52 such that an outer face 78 of the bushing 64 is pressed into contact with the head 58 of the lug 52. This provides an electrical pathway from the bushing 64 to the varistor stack 104.

In the assembled state, the coupling component 74 may be threadingly received in each of the bushing 64 and the plug 70. The plug may include a drive head 80 such that rotation of the drive head 80 allows the arrester 10 to be connected to and disconnected from the bushing 64.

In some embodiments, the body 12 includes an additional inner layer 82 of conductive material (e.g., conductive EPDM). The layer 82 may surround an upper portion of the first channel 32 of the first leg and may surround the first end fitting 116 to provide a faraday cage.

A protective cover 84 may be positioned over the plug 70 after attaching the arrester 10 to the bushing 64. The protective cover, like the arrester body 12, may be electrically shielded and may be one of the components that provide an arrester that is fully electrically shielded. The protective cover 84 may be the same material as the arrester body 12.

The present invention applies to surge arresters used in power applications that involve a fault current. It applies to devices needing fault current protection to prevent or minimize physical damage in the event of a short circuit. Surge arresters according to embodiments described herein eliminate or minimize arc flash hazard as well as potential damage to installed equipment such as a power transformer.

Surge arresters according to embodiments described herein use a high-voltage fuse that disconnects a circuit when more than rated current flows. Surge arresters according to embodiments described herein are capable of interrupting a high current scenario such as in a fault. Surge arresters according to embodiments described herein are capable of failing open and are capable of withstanding the rated line to ground voltage upon opening of the fuse. This allows products such as surge arresters, when stressed beyond their capability, to fail without catastrophic power arc. Surge arresters according to embodiments described herein eliminate or minimize damage associated with the effects of a power arc resulting from a short circuit mode of the arrester.

Known arresters that comply with standards do fail relatively safely but no known arresters fail without a short circuit arc that causes equipment (e.g., transformer) damage and potentially exposes utility workers to arc flash hazard. Surge arresters according to embodiments described herein include the fuse to trap the fault energy within the device thereby preventing any arc fault related concerns.

Referring again to FIG. 2A, the surge arrester 10 may include an indicator 140 such as an LED. The indicator 140 may be electrically connected to the varistor stack 104 and may be on the body 12 (e.g., on the first leg 20 of the body 12). Alternatively, the indicator 140 may be electrically connected to the ground terminal 46. The indicator 140 may allow a technician to know when the fuse 120 has blown. For example, the indicator 140 may illuminate when leakage current flows through the varistor stack 104 (e.g., when the fuse 120 is in closed state). The indicator 140 may stop illuminating when the fuse 120 has operated (e.g., when the fuse 120 is in an open state). This may prompt the technician to replace the surge arrester 10.

Figure 5:
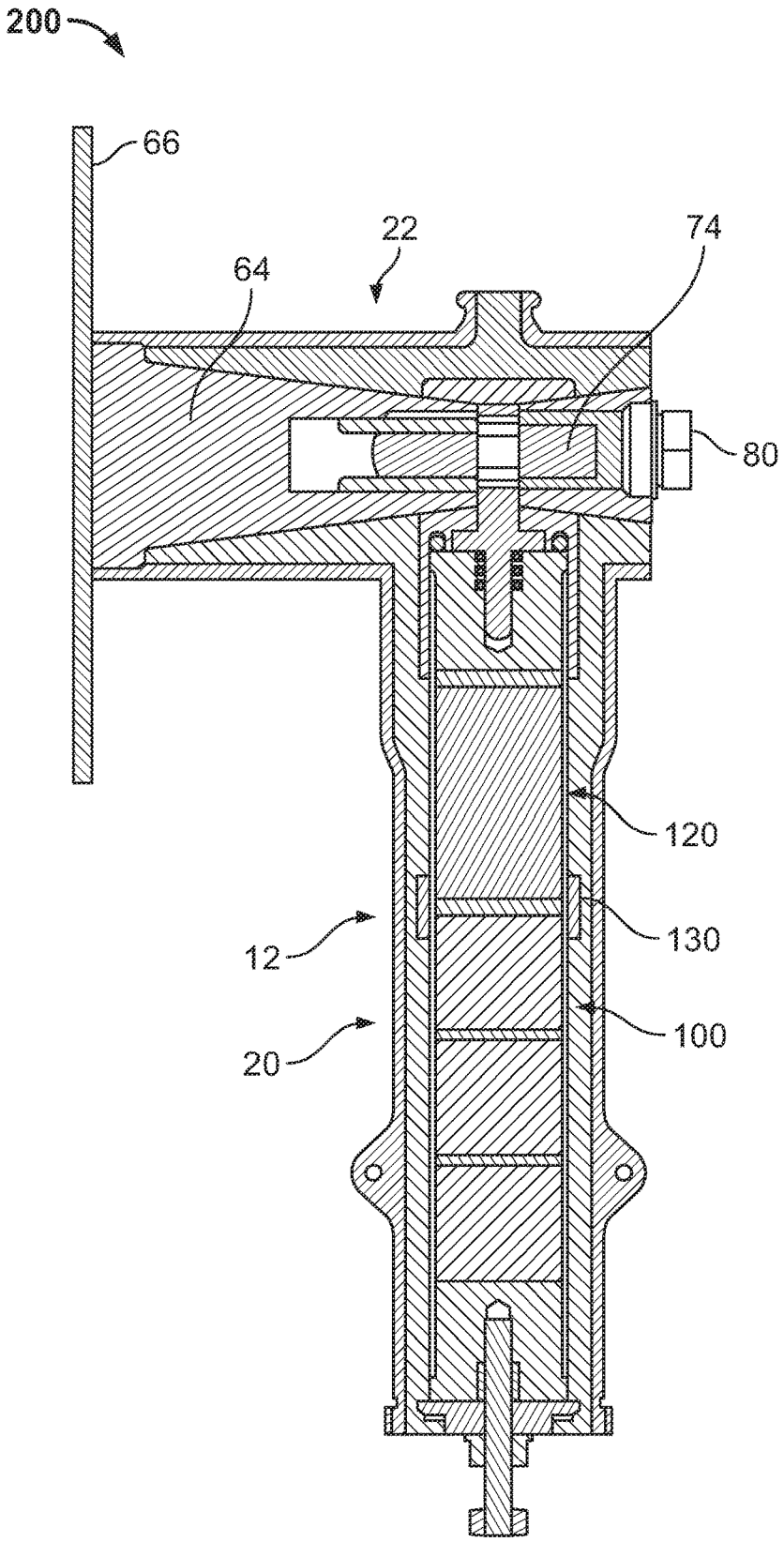
FIG. 5 is a sectional view of a surge arrester according to some other embodiments.

FIG. 5 illustrates an elbow surge arrester 200 that is substantially similar to the T-shaped surge arrester described above. The primary difference is the omission of the plug 70. In some embodiments, the drive head 80 directly engages the coupling component 74 that is connected to the bushing 64. The fuse 120 may be in any of the positions shown in FIGS. 2-4 and the semiconductor layer(s) 130/130A/130B, where used, may also be in any of the configurations shown in FIGS. 2-4.

Figure 6:
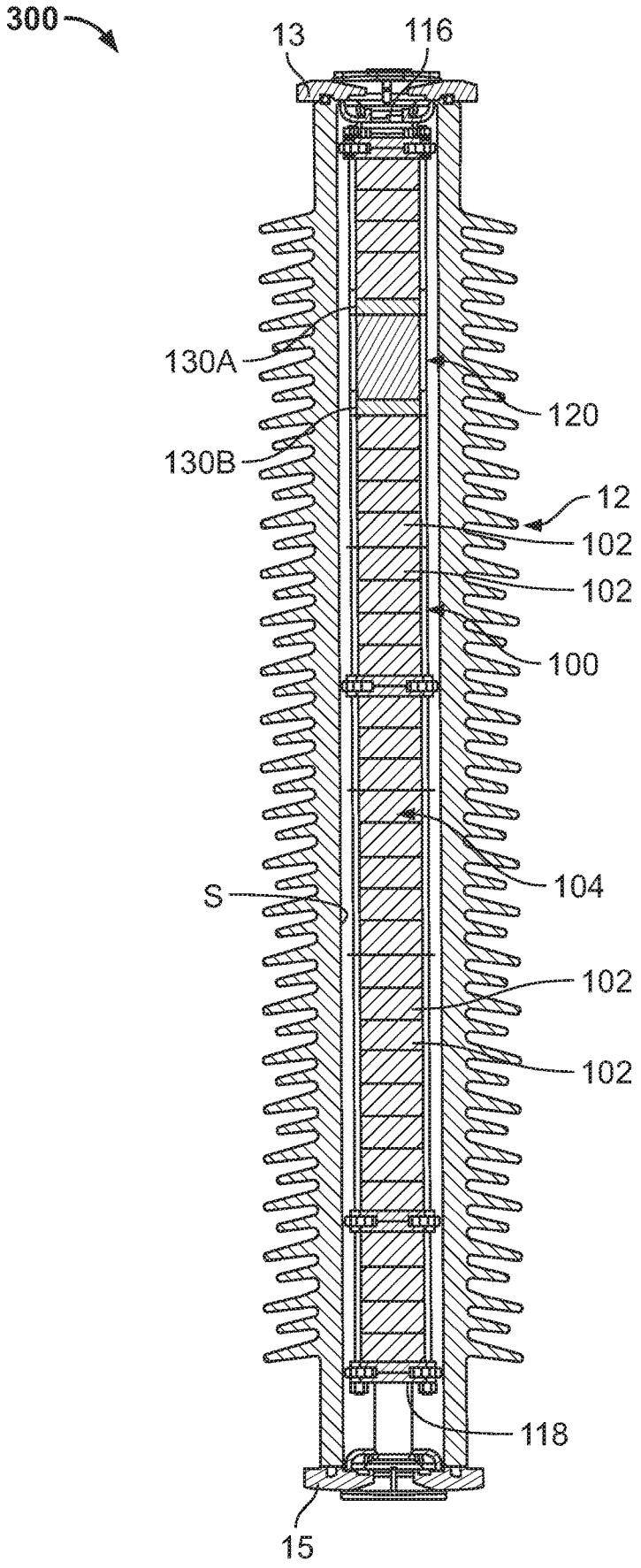
FIG. 6 is a sectional view of a surge arrester according to some other embodiments.

FIG. 6 illustrates another surge arrester 300 that includes a housing 12 (e.g., porcelain housing) a first end plate 13, and a second end plate 15 that collectively define an interior space S. The varistor assembly 100 is in the interior space S of the housing 12 with the first end fitting 116 connected to the first end plate 13 and the second end fitting 118 connected to the second end plate 15. The fuse 120 may be in any of the positions shown in FIGS. 2-4 and the semiconductor layer(s) 130/130A/130B, where used, may also be in any of the configurations shown in FIGS. 2-4. Further details of the surge arrester 300 are described in U.S. Pat. No. 10,304,598, the disclosure of which is incorporated by reference herein in its entirety.

Figure 7:
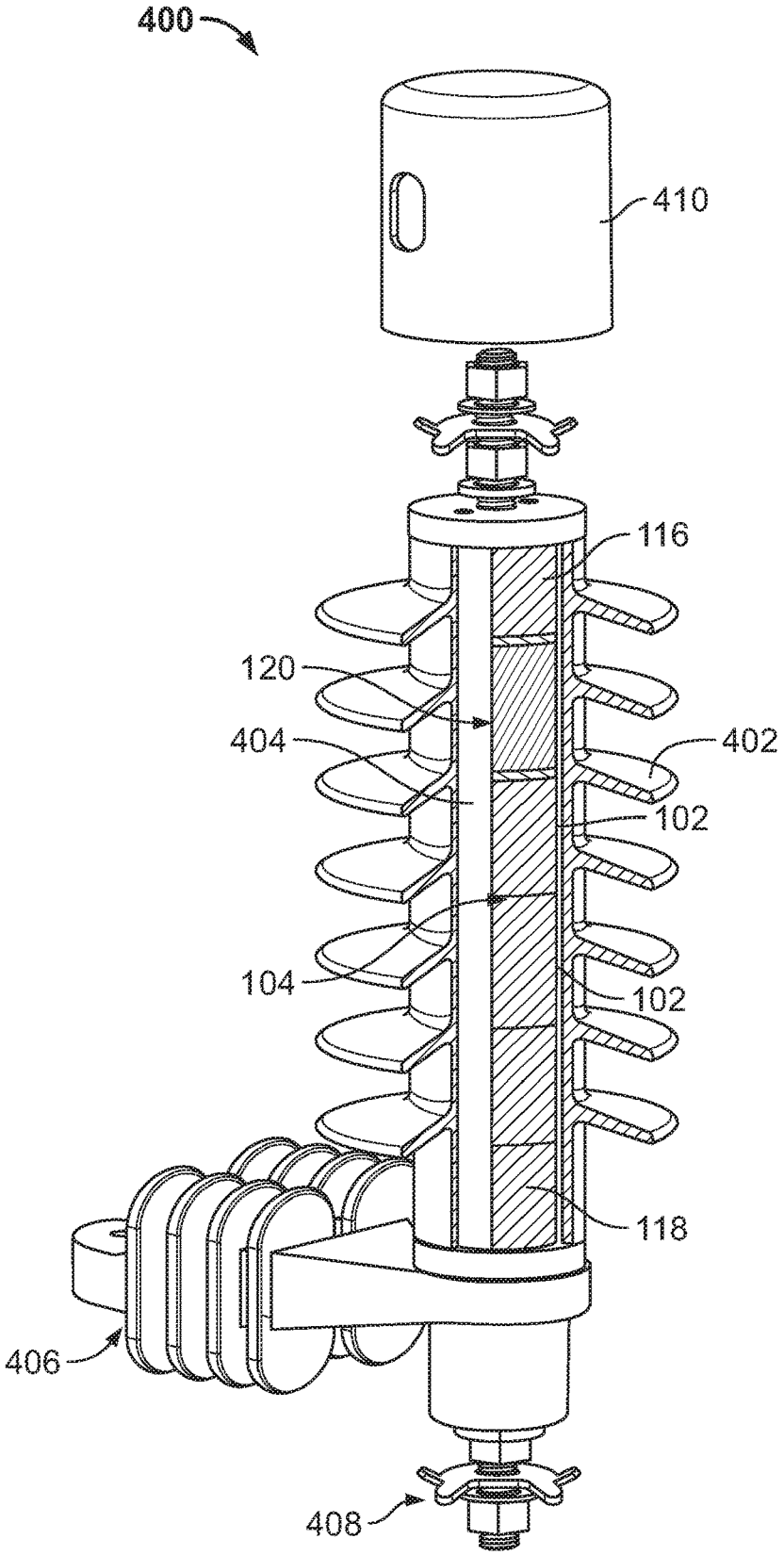
FIG. 7 is a partial cutaway perspective view of a surge arrester according to some other embodiments.

FIG. 7 illustrates another surge arrester 400 that includes a housing 402 that may be polymeric or elastomeric (e.g., a silicone rubber housing). Inside the housing 402 is a varistor stack 104 including one or more varistor elements 102 and a fuse 120. The fuse 120 may be in any of the positions shown in FIGS. 2-4. First and second end fittings 116, 118 are at opposite ends of the stack 104. A wrap 404 may completely surround the varistor stack 104. In some embodiments, the wrap 404 surrounds or completely surrounds the first end fitting 116 and/or the second end fitting 118. The wrap 404 may be a flame retardant glass filled epoxy laminate.

The arrester 400 may include a bracket 406 and an earth lead disconnector (ELD) clamp 408. A birdcap 410 may be at the top of the housing 402.

Figure 8:
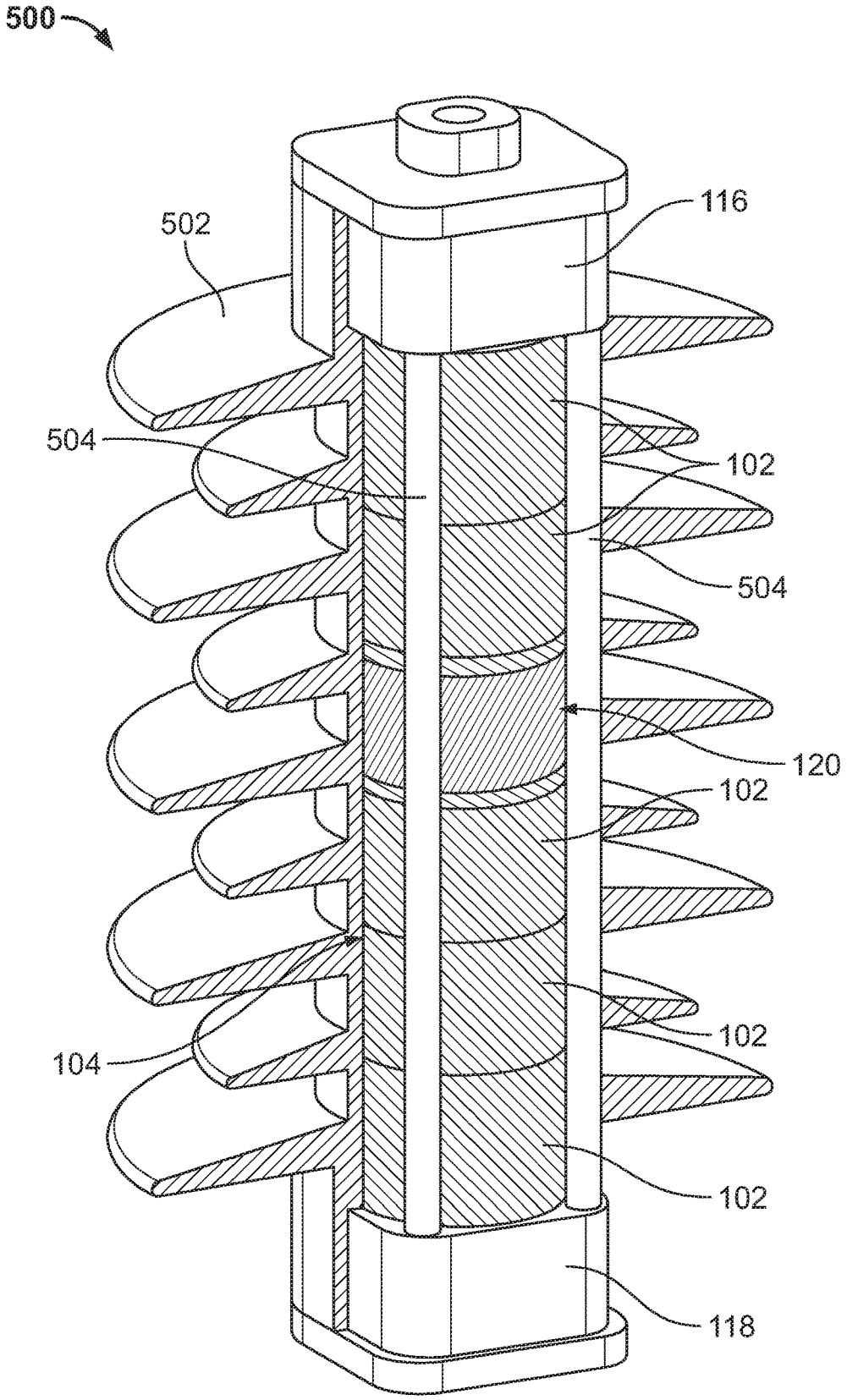
FIG. 8 is a partial cutaway perspective view of a surge arrester according to some other embodiments.

FIG. 8 illustrates another surge arrester 500 that includes a housing 502 that may be polymeric or elastomeric (e.g., a silicone housing). Inside the housing 502 is a varistor stack 104 including one or more varistor elements 102 and a fuse 120. The fuse 120 may be in any of the positions shown in FIGS. 2-4. First and second end fittings 116, 118 are at opposite ends of the stack 104.

A cage including a plurality of rods 504 may surround the varistor stack 104. The rods 504 may extend between the first and second end fittings 116, 118.

Figure 9:
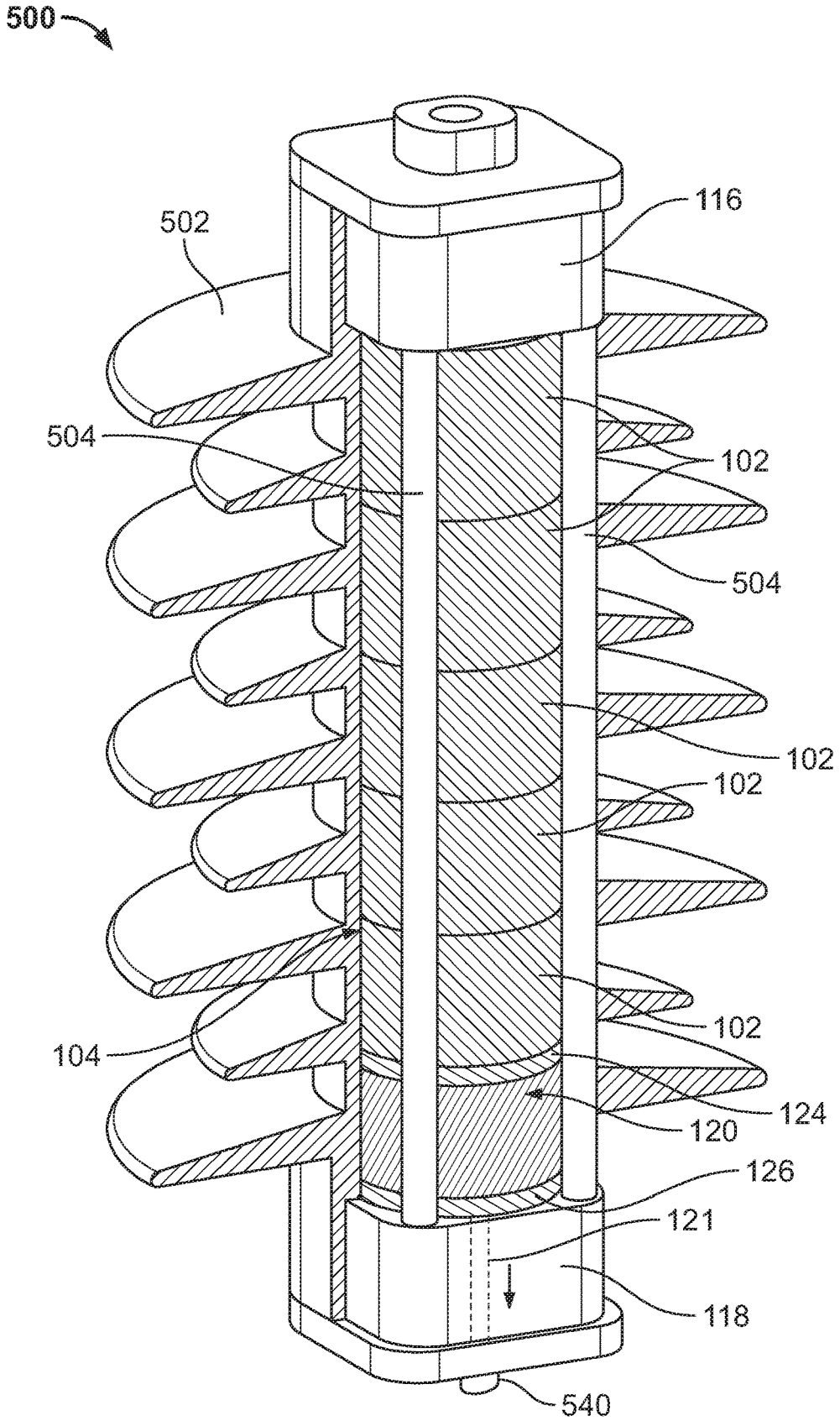
FIG. 9 is a partial cutaway perspective view of a modified version of the surge arrester of FIG. 8.

FIG. 9 is a modified example of the surge arrester 500 of FIG. 8. The fuse 120 is positioned at the bottom of varistor stack 104. The fuse 120 includes a striker pin 121 that protrudes from the second endcap 126 when the fuse operates. In some embodiments, the striker pin 121 penetrates the end fitting 118 and provides a visual indicator that the fuse 120 has operated. In some other embodiments, the striker pin 121 may engage or trigger an indicator 540 such as a block, flag, or the like to cause the indicator 540 to deploy from the end fitting 118. The striker 121 or the indicator 540 may allow a technician on the ground to identify surge arresters that have blown or operated fuses.

It is also contemplated that any of the surge arresters described herein may wirelessly communicate to outside devices when the fuse has operated. The surge arrester may include a communication device that communicates to the outside device by, for example, a text message or an alert on a mobile application.

The electrical and/or mechanical indicator serves as an indicator that a particular arrester is disconnected from the system allowing the line crews to quickly identify the faulted arrester and other equipment and restore protection by replacing the damaged or failed unit.

The arresters 400 and 500 may be used for outdoor applications. The arresters 400 and 500 may prevent electrical arcing and sparks to mitigate electrically induced fires. By diverting the short circuit current to the fuse body, external arcing is prevented and contained within the body.

As described in part above, the incorporation of the fuse in the surge arresters described herein provides several advantages. The fuse is intended to suppress the arc within the fuse body and minimize or prevent external arc flash that can cause potential fire hazard. The fuse is also intended to transfer arcing that can happen with a arrester or equipment disconnect device to within the fuse body thereby reducing or eliminating potential arc flash and fire hazard. The fuse is also intended to minimize or eliminate external arc flash that can happen across the arrester or other equipment by fast disconnection and arc suppression. Additionally, the fuse can prevent nuisance outages due to arrester or equipment failures by early disconnection before the arrester has a complete failure. This may be determined by the fuse current rating based on application.

Figure 10:
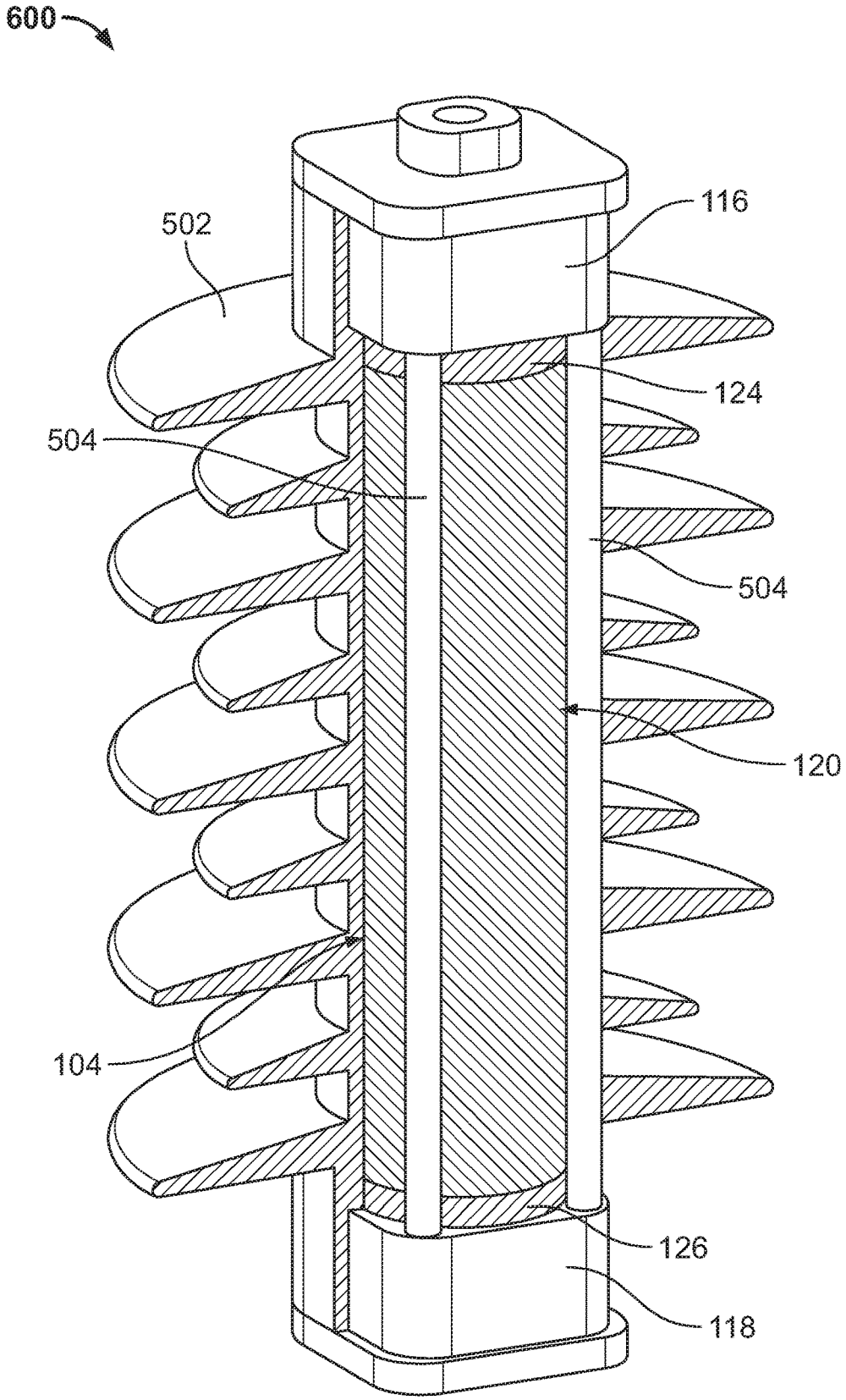
FIG. 10 is a partial cutaway perspective view of a fuse holding device according to some other embodiments.

FIG. 10 illustrates a high voltage fuse holding device 600 with short circuit protection. The device 600 includes a housing 502 which may be as described above with regard to FIG. 8. Inside the housing 502 is a fuse 120 as described herein. The fuse 120 includes first and second endcaps 124, 126. First and second end fittings 116, 118 are at opposite ends of the fuse 120. The first endcap 124 may contact the first end fitting 116 and/or the second endcap 126 may contact the second end fitting 118.

A cage including a plurality of rods 504 may surround the fuse 120. The rods 504 may extend between the first and second end fittings 116, 118.

The device 600 is a fuse holder that can withstand external contamination.

Figure 11:
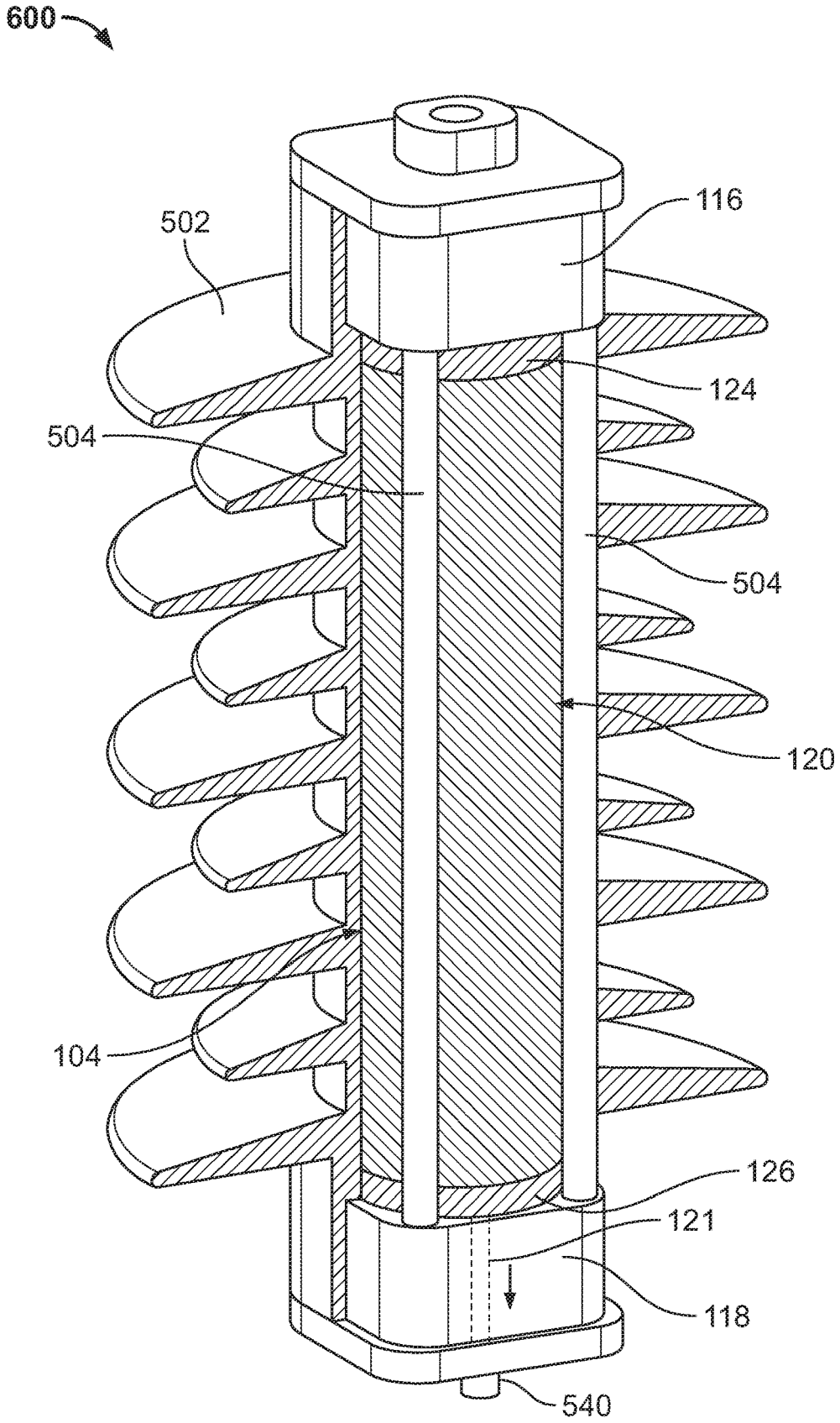
FIG. 11 is a partial cutaway perspective view of a modified version of the fuse holding device of FIG. 10.

FIG. 11 is a modified version of the fuse holder 600 of FIG. 10. The fuse 120 includes the striker pin 121 and the indicator 540 may be provided as described above with regard to FIG. 9.

Figure 12:
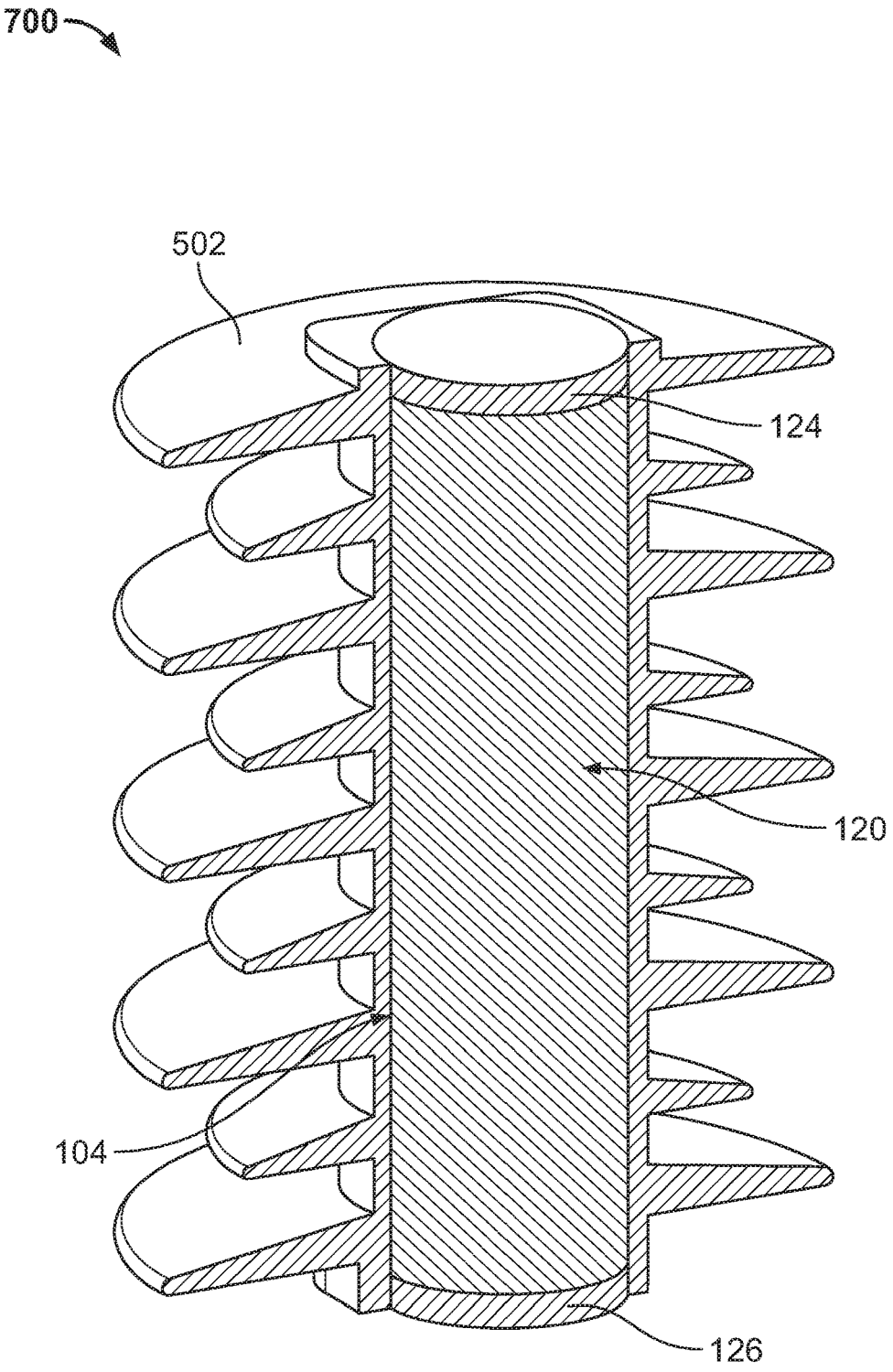
FIG. 12 is a partial cutaway perspective view of a fuse holding device according to some other embodiments.

FIG. 12 illustrates a high voltage fuse holding device 700. The device 700 includes a housing 502 that may be as described above with regard to FIG. 8. Inside the housing 502 is a fuse 120 as described herein. The fuse 120 includes first and second endcaps 124, 126. Electrical connection can be made with the endcaps 124, 126.

The housing 502 may be a heat shrink or cold shrink weathershed applied over the body of the fuse 120. This configuration may not have the additional strength to hold pieces of fuse in case of a failed short circuit interruption as the rods (see, for example, FIG. 9) have been omitted and therefore may rely on the body of the fuse 120 for strength. However, this configuration would have contamination performance after the fuse operates due to the housing including the weather sheds.

Figure 13:
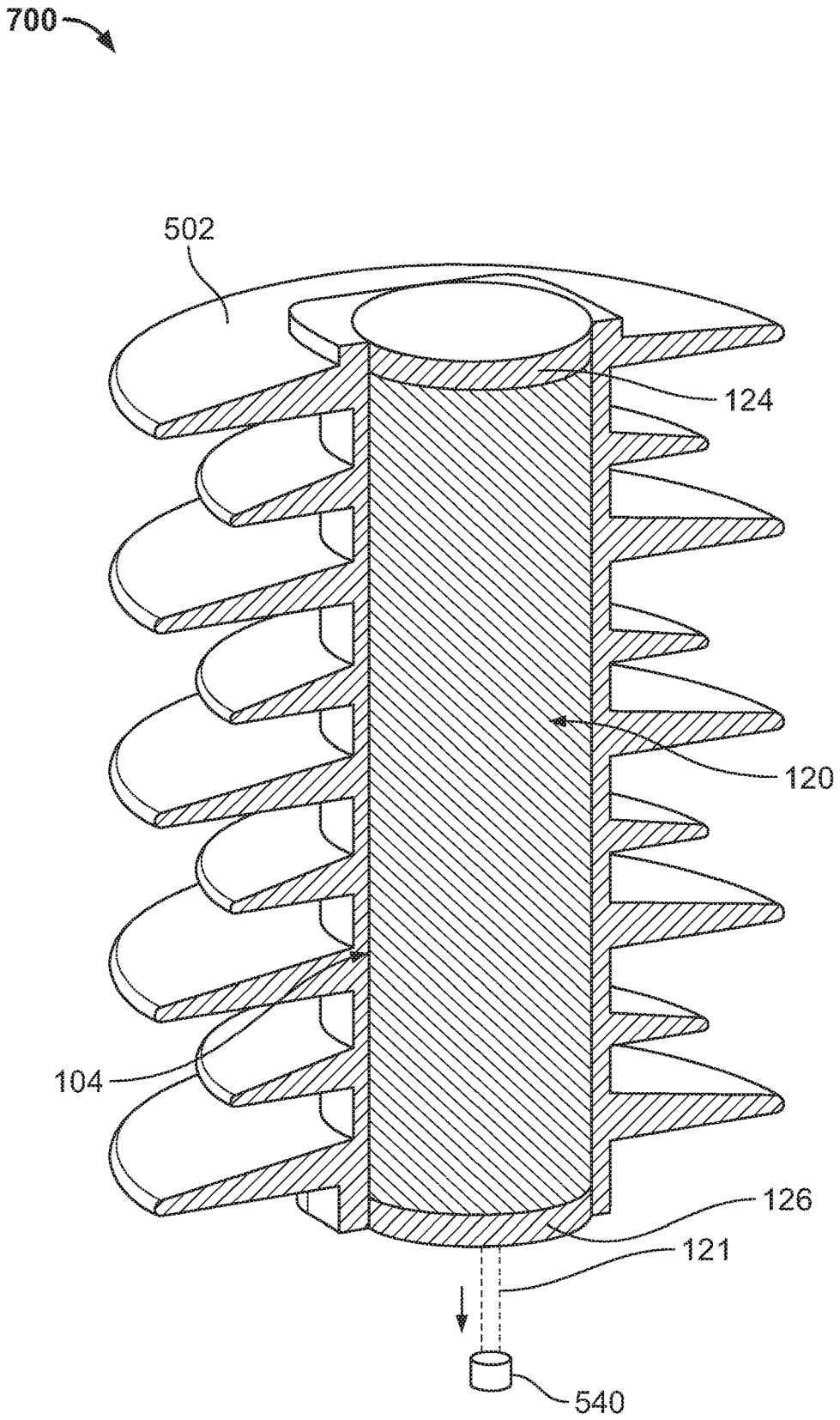
FIG. 13 is a partial cutaway perspective view of a modified version of the fuse holding device of FIG. 12.

FIG. 13 is a modified version of the fuse holder 700 of FIG. 12. The fuse 120 includes the striker pin 121 and the indicator 540 may be provided as described above with regard to FIG. 9.

In some embodiments, the fuse holders 600, 700 can be connected in series electrically with a surge arrester including varistor elements (e.g., as a retrofit part).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

What is claimed is:

1. A surge arrester comprising:

a polymer body or housing; and a varistor assembly in the body or housing, the varistor assembly comprising:

a plurality of varistor elements and a fuse electrically connected in series and forming a vertical stack of the plurality of varistor elements and the fuse, wherein the stack has a first end surface, a second end surface, and an outer side surface extending between the first end surface and the second end surface;

a first end fitting at the first end surface of the stack; and a second end fitting at the second end surface of the stack, wherein the fuse comprises a body, a first endcap at a first end of the body, and a second endcap at a second, opposite end of the body, and wherein the surge arrester further comprises at least one annular semiconductor layer that contacts and surrounds at least one of the first and second endcaps of the fuse.

2. The surge arrester of claim 1 wherein:

the fuse is positioned at a top of the stack such that the first endcap defines the first end surface of the stack; and the plurality of varistor elements are positioned below the fuse.

3. The surge arrester of claim 2 wherein the first endcap contacts the first end fitting.

4. The surge arrester of claim 2 wherein the at least one annular semiconductor layer contacts and surrounds the second endcap.

5. The surge arrester of claim 4 wherein the at least one annular semiconductor layer completely surrounds the fuse.

6. The surge arrester of claim 4 wherein the at least one annular semiconductor layer contacts each of the fuse body and the varistor element directly below the fuse.

7. The surge arrester of claim 1 wherein:

the fuse is positioned at a bottom of the stack such that the second endcap defines the second end surface of the stack; and the plurality of varistor elements are positioned above the fuse.

8. The surge arrester of claim 7 wherein the second end cap contacts the second end fitting.

9. The surge arrester of claim 8 wherein the fuse comprises a striker pin that, upon operation of the fuse, protrudes through the second endcap and operates an indicator that is visible from below the surge arrester.

10. The surge arrester of claim 7 wherein the at least one annular semiconductor layer contacts and surrounds the first endcap.

11. The surge arrester of claim 10 wherein the at least one annular semiconductor layer comprises a first annular semiconductor that contacts and surrounds the first endcap and a second annular semiconductor layer that contacts and surrounds the second endcap.

12. The surge arrester of claim 11 wherein:

the first annular semiconductor layer contacts each of the fuse body and the varistor element directly above the fuse; and the second annular semiconductor layer contacts each of the fuse body and the second end fitting.

13. The surge arrester of claim 1 further comprising an indicator electrically connected to the stack and configured to indicate when the fuse has operated, wherein the indicator is optionally on the body or housing.

14. The surge arrester of claim 1 wherein:

the body or housing comprises a first leg having a first channel defined therein;

the body or housing comprises a second leg perpendicular to the first leg and having a second channel defined therein, the second channel configured to receive a bushing; and the varistor assembly is in the first channel.

15. The surface arrester of claim 1 further comprising a cage in the body or housing, the cage comprising a plurality of rods surrounding the stack.

16. The surge arrester of claim 1 wherein the at least one annular semiconductor layer completely surrounds the fuse and completely surrounds the stack.

17. A surge arrester comprising:

a polymer body or housing; and a varistor assembly in the body or housing, the varistor assembly comprising:

a plurality of varistor elements and a fuse electrically connected in series and forming a vertical stack of the plurality of varistor elements and the fuse, wherein the stack has a first end surface, a second end surface, and an outer side surface extending between the first end surface and the second end surface;

a first end fitting at the first end surface of the stack; and a second end fitting at the second end surface of the stack, wherein the fuse is positioned at an interior of the stack with at least one of the plurality of varistor elements above the fuse and at least one of the plurality of varistor elements below the fuse.

18. The surge arrester of claim 17 further comprising:

a first annular semiconductor layer contacting and surrounding the first endcap; and a second annular semiconductor layer contacting and surrounding the second endcap, the second annular semiconductor layer vertically spaced apart from the first annular semiconductor layer.

19. The surge arrester of claim 18 wherein:

the first annular semiconductor layer contacts each of the fuse body and the varistor element directly above the fuse; and the second annular semiconductor layer contacts each of the fuse body and the varistor element directly below the fuse.

20. A surge arrester comprising:

a polymer body or housing; and a varistor assembly in the body or housing, the varistor assembly comprising:

a plurality of varistor elements and a fuse electrically connected in series and forming a vertical stack of the plurality of varistor elements and the fuse, wherein the stack has a first end surface, a second end surface, and an outer side surface extending between the first end surface and the second end surface;

a first end fitting at the first end surface of the stack; and a second end fitting at the second end surface of the stack, wherein the fuse comprises a body, a first endcap at a first end of the body, and a second endcap at a second, opposite end of the body, wherein the fuse is positioned at a top of the stack such that the first endcap defines the first end surface of the stack, and wherein the plurality of varistor elements are positioned below the fuse.

* * * * *